US005669859A

United States Patent [19]

Liggett et al.

[11] Patent Number: 5,669,859

[45] Date of Patent: Sep. 23, 1997

[54] WEIGHTLIFTING APPARATUS

[76] Inventors: Mariah T. Liggett, 1784 Kings Ct., Apartment D, Columbus, Ohio 43212; Stephen A. Skilken, 383 S. Third St., Columbus, Ohio 43215; Pierce L. Miller, 7235 Davis Rd., Hilliard, Ohio 43026

[21] Appl. No.: 590,270

[22] Filed: Nov. 21, 1995

[51] Int. Cl.[6] ..... A63B 21/078

[52] U.S. Cl. ..... 482/94; 482/98; 482/101

[58] Field of Search ..... 182/94, 98, 101, 182/104, 135, 148

[56] References Cited

U.S. PATENT DOCUMENTS

| | | | |
|---|---|---|---|
| D. 303,697 | 9/1989 | Pearson | D21/198 |
| D. 305,256 | 12/1989 | Pearson | D21/198 |
| 3,235,255 | 2/1966 | Leflar . | |
| 4,602,785 | 7/1986 | Rockwell . | |
| 4,615,524 | 10/1986 | Sutherland . | |
| 4,795,149 | 1/1989 | Pearson | 482/98 |
| 4,799,672 | 1/1989 | Barrett . | |
| 4,836,535 | 6/1989 | Pearson . | |
| 4,934,693 | 6/1990 | Santoro . | |
| 4,982,957 | 1/1991 | Shields . | |
| 5,050,868 | 9/1991 | Pearson . | |
| 5,151,072 | 9/1992 | Cone et al. | 482/104 |
| 5,184,992 | 2/1993 | Banks | 482/104 |
| 5,215,510 | 6/1993 | Baran | 482/104 |
| 5,273,506 | 12/1993 | Dawson | 482/104 |

*Primary Examiner*—Richard J. Apley
*Assistant Examiner*—John Mulcahy
*Attorney, Agent, or Firm*—Standley & Gilcrest

[57] ABSTRACT

A multi-exercise free weight exercise apparatus which simulates free weight barbell exercise motions while preventing injury to a weightlifter. The weightlifting apparatus is comprised of a weight bar which rides on horizontal and vertical guide tracks and contains a safety catch mechanism device which latches onto pins located on upright brace supports should the weightlifter be unable to complete an exercise. The apparatus will allow a lifter to perform sophisticated exercises such as squatlifts, bench presses, deadlifts, and military presses in a natural free weight exercise motion while having the safety features of a non-free weight machine.

16 Claims, 5 Drawing Sheets

WEIGHTLIFTING APPARATUS

BACKGROUND OF THE INVENTION

The present invention relates generally to exercise equipment and, more particularly, to an improved multi-use free-weight apparatus.

Weightlifters perform various exercises for the purpose of developing muscles throughout the body. These exercises can be performed through the use of free weights, such as barbells, or by way of machines such as Nautilus® machines. Many weightlifters prefer using free weight barbells over machines because free weights allow the lifter to perform the exercises in a natural motion while utilizing pure body leverage in performing the exercise (this is especially true for professional weightlifters who train for competitions in lifting.) This allows the lifter to better isolate the muscles the exercise is intended to develop, and to mimic real athletic sports motions. Although machines are designed and assembled to duplicate or simulate the free weight exercises, in practice these machines do not allow the lifter to perform the exercise in its natural motion due to the mechanical limitations inherent in the machines.

Although many weightlifters prefer to use free weights over machines in performing exercises, many lifters are forced to use the machines due to safety reasons. If a lifter does not have a "spotter", or a person who watches over and assists the lifter when he or she cannot complete the exercise, it is very dangerous to exercise with free weights. Machines, on the other hand, are usually designed so that the lifter can terminate the exercise at anytime on his or her own. Hence, a weightlifting device is needed which has the safety features of current weightlifting machines while allowing the lifter to perform the exercise within the range of natural motion which he or she would have with the use of free weights. For example, such a "spotter-less free weight" device or apparatus is needed for performing the exercises such as the bench press and squat.

The squat-lift is an exercise which works the leg, hip and back muscles. The weightlifter performs the squatting motions by performing a deep knee bend while resting a long barbell on his or her shoulders. The bench press is an exercise that develops the chest and arm muscles. The lifter lies on his or her back and pushes a long barbell, with both hands, in an up and down motion over the chest area. These exercises are often performed with free weight barbells (free weights refer to barbells which are not attached to a machine in any way, and therefore, the lifter has the ability to perform the exercise in a natural motion). Depending upon the particular weightlifter, these exercises are often performed with very heavy weights (many serious weightlifters can squat over 500 pounds and bench press over 300 pounds).

For safety reasons, the squat-lift and the bench press using free weights should be performed with a spotter or other assistance. It is easy to imagine how dangerous it would be for a lifter if he or she were unable to finish a repetition of the exercise. A squatter with a heavy barbell on his or her shoulders unable to rise from the deep knee bend position, or a lifter doing the bench press, who is unable to push up a heavy barbell resting on his chest, can sustain serious injury if a spotter is absent to assist that person. If spotting assistance is unavailable, machines can be used to perform these exercises. However, as previously discussed, these machines do not allow the lifter to perform the exercise in a natural motion with a standard competition barbell. Accordingly, even absent a spotter, many weightlifters prefer to use free weights, rather than the safer machine alternatives, when performing the squat and bench press exercises.

The typical known apparatus found for performing the squat and bench press has safety pins, mounted on a vertical frame, located approximately 4 to 6 inches apart vertically to provide a place at varying heights to set a weight bar. The weight bar has a hook attached to it which catches the pins. In the known machines, the weight bar is attached to its own separate frame which is rigidly attached to the frame of the machine at a fixed distance from the plane of the safety pin frame. Due to the weight bar frame being rigidly attached to the machine frame, the known machines do not allow horizontal motion of the weight bar. The known machines merely allow the lifter to move the weight bar in an up and down, or straight vertical motion. The majority of free weight barbell exercise motions, especially true for the squat and bench press, do not travel in a strict vertical up and down path - there needs to be a horizontal movement as well. For example, in the bench press, a barbell travels in an arched up and down path, with an estimated 12–18 inch horizontal change during the descent and ascent phases. The typical known apparatus does not allow for this, and therefore a "true", or natural, bench press motion is not permitted by the known machines. This restriction of horizontal movement results in a perception of weight (exertion) which is higher than actual poundage of free weight (it is more difficult to move weights in a restricted, single plane, compared to an open, multi-dimensional plane). Additionally, the restriction of motion does not allow the lifter to properly isolate the muscles the exercises are intended to work, or to simulate the competition lift.

The rigid attachment of the weight bar frame in the known machines also causes problems with the "hook and latch" method used to catch and support the weight bar, upon completion of the exercise. Due to the restriction of horizontal movement of known machines, a lifter must twist the bar and its hook off the retaining pins to perform the exercise, and re-twist it back onto the pins upon completion of the exercise. This twisting motion poses a high potential for injury if it is not hooked as well as putting a strain on the wrist muscles and joints of the lifter.

Hence, there is a need for a free weight device which contains safety mechanisms of traditionally known weightlifting devices while allowing the lifter to simulate free weight barbell movements. As discussed, there is also a need for such a device which incorporates an ability to hook and lock a barbell into place without a twisting motion required with the known apparatus.

SUMMARY OF THE INVENTION

It is therefore an object of this invention to provide an apparatus which is relatively simple in construction and use which allows a weightlifter to perform exercises in a natural, unrestricted motion while providing for the safety of the lifter.

It is another object of this invention to provide a new safety catch system which is an improvement over the typical "bar-twist" system of the prior art machines.

It is another object of this invention to provide a complete walk-in rack apparatus that lifters could perform all weight exercises in with unlimited rack and pin options and heights.

These and other objects of the invention, as will be apparent herein, are accomplished by the Weightlifting Apparatus of the present invention comprising: a first front upright brace support member, with first and second ends; a second front upright brace support member, with a first and second end; a pair of vertical guide track support members with a first and second end; a pair of lower horizontal guide track members; a pair of lower movable guide sleeves, attached to the first end of the pair of vertical guide track support members and where the lower movable guide sleeves move horizontally along the pair of lower horizontal guide track members; a pair of guide sleeve assemblies, movably attached to the pair of vertical guide track members and where the guide sleeve assemblies move parallel to each other along the pair of vertical guide track support members; a pair of safety catch mechanisms which form a part of the pair of guide sleeve assemblies; a weight bearing bar supported by the pair of guide sleeve assemblies; and a means for catching the pair of safety catch mechanisms which forms a part of the first and second front upright brace support members.

It is preferred that the weightlifting apparatus, further comprise: a first back upright brace support member, with a first and second end; a second back upright brace support member, with a first and second end; a pair of upper horizontal guide track members; a pair of upper movable guide sleeves, attached to the second end of the pair of vertical guide track support members and where the upper movable guide sleeves move horizontally along the pair of upper horizontal guide track members; and where the means for catching the pair of safety catch mechanisms are pins attached to the first and second front upright brace supports.

It is also preferred that the weightlifting apparatus be further comprised of pins attached to the first and second back upright brace supports.

It is also preferred that the pins attached to the first and second from upright brace supports are precisely staggered with the pins attached to the first and second back upright brace supports.

It is preferred that the pair of safety catch mechanisms are each comprised of a primary hooking mechanism which latches onto the pins of the first and second front upright brace support members.

It is also preferred that the pair of safety catch mechanisms are each further comprised of a tail hook mechanism for the purposes of latching onto the pins of the first and second back upright brace support members.

It is preferred that the pair of safety catch mechanisms latch onto the pins upon placement onto said pins.

It is preferred that the Weightlifting Apparatus of the present invention be further comprised of an adjustable safety bar mechanism which prevents the weight bearing bar from descending past a predetermined, set position.

The weight bearing bar of the present invention moves in both the vertical and horizontal directions.

BRIEF DESCRIPTION OF THE DRAWINGS

Novel features and advantages of the present invention in addition to those mentioned above will become apparent to those skilled in the art from a reading of the following detailed description in conjunction with the accompanying drawings wherein similar reference characters refer to similar parts and in which.

DETAILED DESCRIPTION OF THE PREFERRED EMBODIMENT(S)

The preferred apparatus herein described is not intended to be exhaustive or to limit the invention to the precise forms disclosed. They are chosen and described to explain the principles of the invention, and the application of the method to practical uses, so that others skilled in the art may practice the invention.

Figure 1:
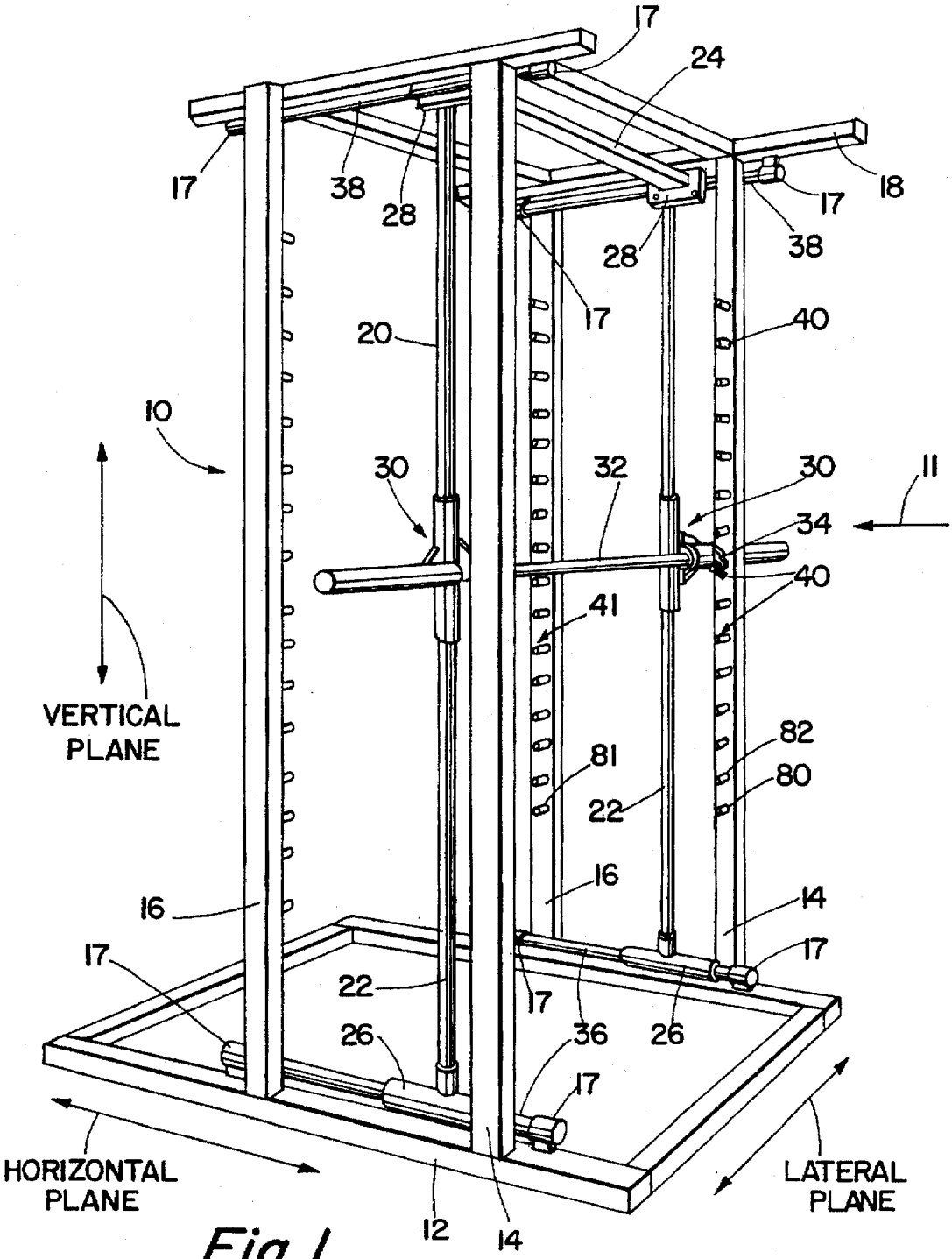
FIG. 1 is a perspective view of a Weightlifting Apparatus of the present invention.

Referring in detail to the drawings and particularly FIG. 1, the free weight exercising apparatus of the present invention 10 is depicted (the arrow 11 in FIG. 1 points in the direction of the front view of the apparatus.) The vertical, horizontal, and lateral directions are indicated by the respective arrows in FIG. 1. The weightlifting apparatus 10 has a base 12, a pair of front upright brace support members 14, a pair of back upright brace support members 16, an upper "base" 18, and a weight bar frame 20 consisting of: a pair of vertical guide track support members 22, an upper support member 24, and a pair of lower and upper movable guide sleeves 26, 28. The front and back upright brace supports 14, 16 serve as the frame for the apparatus which gives support to the apparatus. A pair of guide sleeve assemblies 30, which run along the pair of vertical guide track support members 22, support or hold a weight bearing bar 32 and a pair of safety catch mechanisms 34. The lower and upper movable guide sleeves 26, 28, which are attached to the ends of the vertical guide track support members 22, move in the horizontal direction (as indicated in FIG. 1) along a pair of lower and upper horizontal guide track members 36, 38 which are secured to the base 12 and upper "base" 18. Guide stops 17, located on each end of the lower and upper horizontal guide track members 36, 38 prevent the lower and upper movable guide sleeves 26, 28 from moving off the guide track members 36, 38. The safety catch mechanisms 34 rest on pins 40 which are located on the upright brace supports 14, 16.

The components of the weightlifting apparatus 10 are comprised of materials having the necessary size and strength capabilities for use as a free weight exercising apparatus. It is preferred that the materials used to construct this device be a strong metal. The framework components may be rigidly fixed together by bolts, welding, rivets, or any other similar means. It is preferred that the pair of upright brace support members 14, 16 be welded to the base 12 and upper "base" 18. It is also preferred that the pins 40 be welded to the upright brace support members 14, 16.

Figure 2:
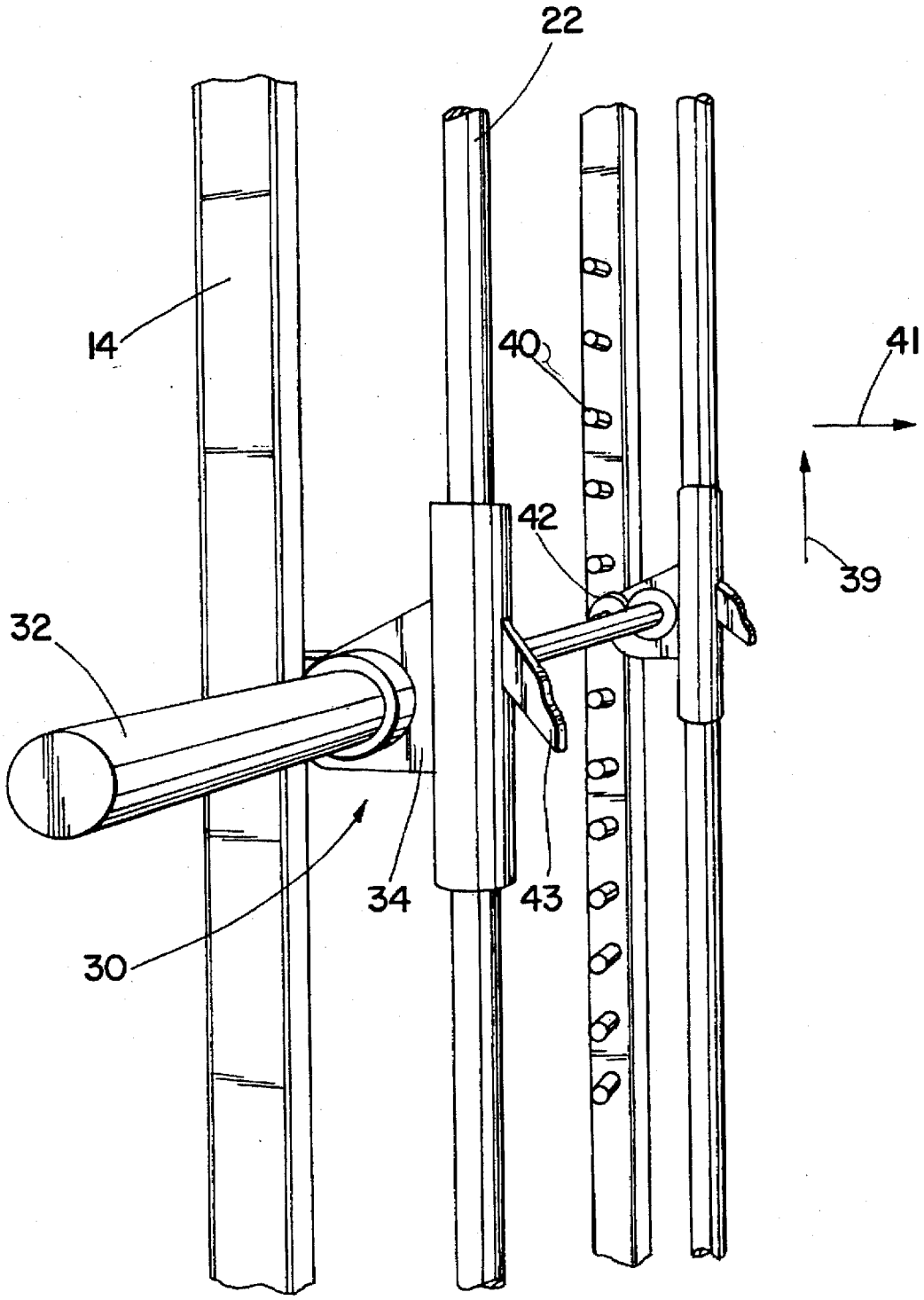
FIG. 2 is a perspective right, side view of the safety latching mechanism of the Weightlifting Apparatus of FIG. 1.

The weight bar 32 is held at a rest position by hooking the safety catch mechanism 34 onto a pair of parallel and corresponding pins 40 ("parallel and corresponding pins" meaning those pins 40 on the front upright brace supports 14, or back upright brace supports 16, which are directly parallel to each other, or in other words pins 40 which are at the same height.) The weight bar 32 can be detached from the pins 40 by pushing the safety catch mechanism up off the pins 40 (direction indicated by arrow 39 of FIG. 2) and horizontally away from the plane of the vertical frame of the device (direction indicated by arrow 41 of FIG. 2.) A close view of the safety catch mechanism 34 of the present invention 10 is shown in FIG. 2. FIG. 2 is a fight side view of the safety catch mechanism 34 of the apparatus 10 as depicted in FIG. 1. Once the safety catch mechanism 34 is free from the pins 40, the weightlifter 44 is free to perform the particular exercise.

Figure 3:
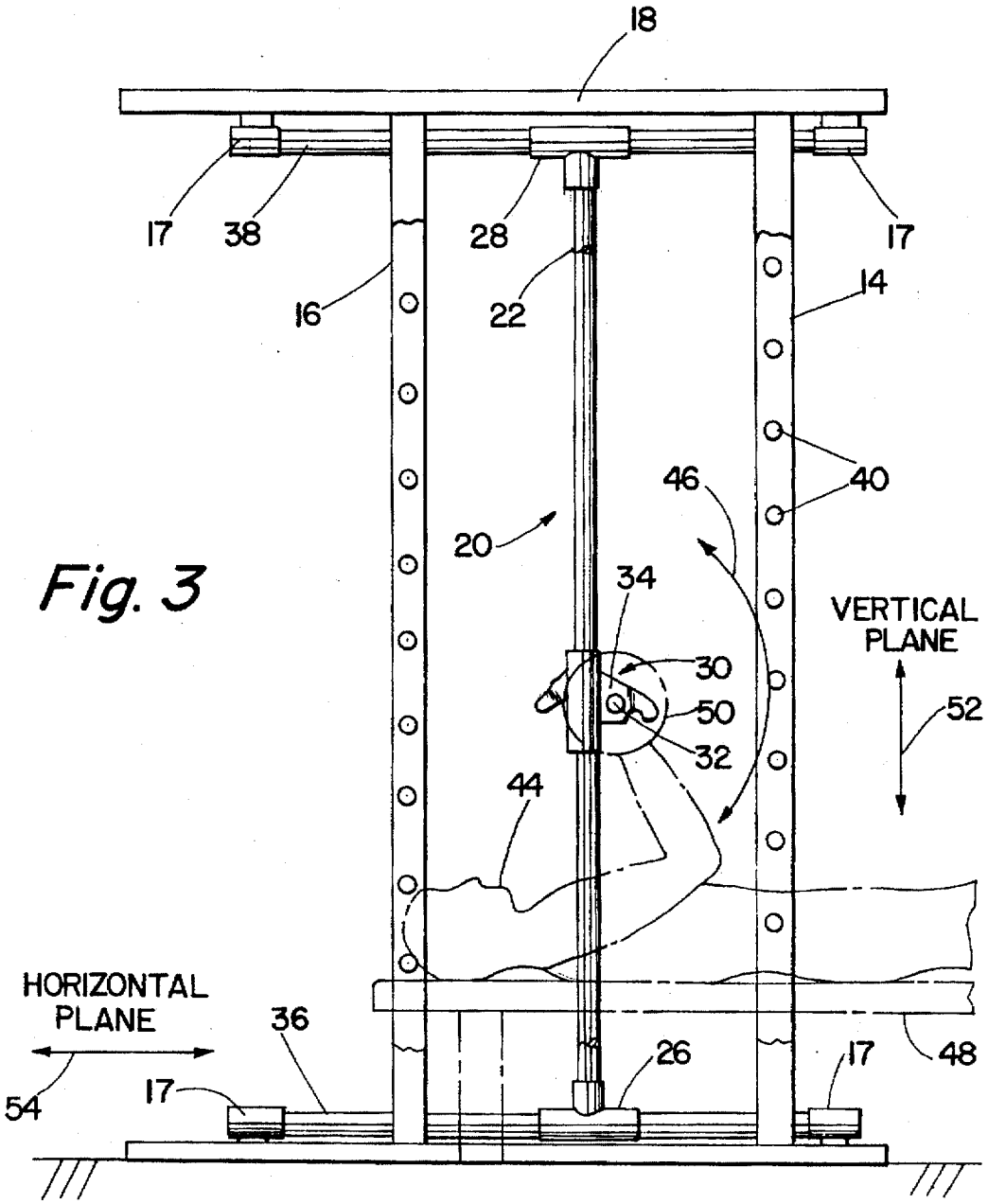
FIG. 3 is a left side view of the Weightlifting Apparatus in use.

FIG. 3 depicts the present invention 10 in use. FIG. 3 shows a weightlifter 44 performing the bench press exercise. In the bench press, the lifter 44 brings the weight bar 32 down to his chest and then pushes the bar up until his arms are fully extended; and then repeats. The arrow 46 shows the natural motion of the weight bar 32 and the weights 50 placed on the bar 32, upon pushing the bar 32 up from the lifter's 44 chest. As shown by the arrow 46, this natural motion is not a perfectly vertical, up and down, motion, as depicted by the arrow 52. Due to the mobility of the weight bar frame 20 in the horizontal direction, as well as the vertical direction, the motion curved motion of the arrow 46 can be accomplished by the present invention. As the lifter 44 pushes the weight bar 32 up and off his chest, the weight bar 32 moves up vertically (as depicted by arrow 52), guided by the vertical guide track support members 22, while the weight bar 32, supported by the weight bar frame 20, simultaneously moves horizontally (as depicted by arrow 54), guided by the lower and upper horizontal guide track members 36, 38. This simultaneous vertical and horizontal movement results in a motion traced by arrow 46.

Similar prior art free weight devices have restricted mobility to the vertical (straight up and down) motion only, as depicted by the vertical arrow 52. The lack of horizontal motion in the prior art devices is caused by the permanent rigidness of the weight bar frame. In other words, in prior art devices, a weight bar frame is welded to the base at a fixed distance from one pair of upright brace support members. Accordingly, the motion of the weight bar is restricted to the straight vertical direction guided by a pair of vertical guide track members.

This horizontal movement allowed by the present invention, allows a weightlifter to perform the exercises, such as the bench press, the squat, dead lifts, and military presses, in a natural, arched motion while keeping the safety mechanisms provided by the mechanical elements of the machine. The safety catch mechanism 34 is comprised of a primary hook portion 42, used to catch or latch the safety catch mechanism 34 onto the safety pins 40 of the front upright supports 14, and a tail hook portion 43, which is used to catch or latch the safety catch mechanism onto the safety pins 41 of the back upright brace supports 16.

For example, if the lifter 44 in FIG. 3 could not complete a repetition in the middle of an up swing, he or she could merely push the weight bar 32 horizontally until the primary hook portions 42 of the safety catch mechanisms 34 came to rest onto a pair of pins 40 on the front upright brace supports 14. The lifter can also place the safety mechanism 34 onto pins 41 on the back upright brace supports 16 by way of the tail hook portion 43 of the safety catch mechanism 34.

The pins 40 located on the front upright brace supports 14 are staggered in position in relation with the pins 41 located on the back upright supports 16. Thus, pin 81 of row of pins 41, lies in a plane about half the distance between the planes in which pins 80 and 82 lie in respectively, in row of pins 40. This allows for a wider range of pin heights which gives greater flexibility and allows for a wider range of exercises and particular user needs.

Figure 5:
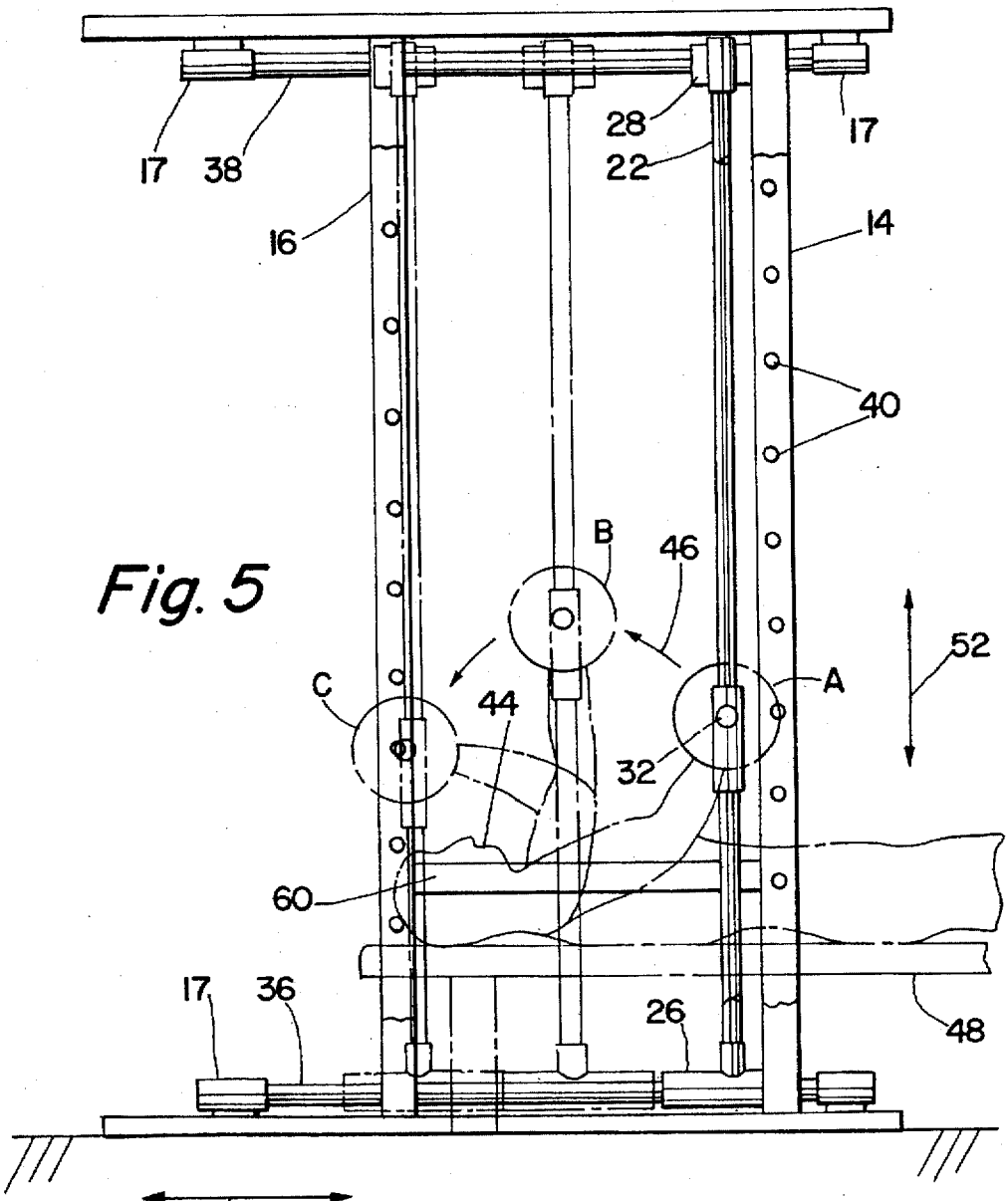
FIG. 5 is a left side view of the apparatus depicting the front and back latching functions.
Figure 6:
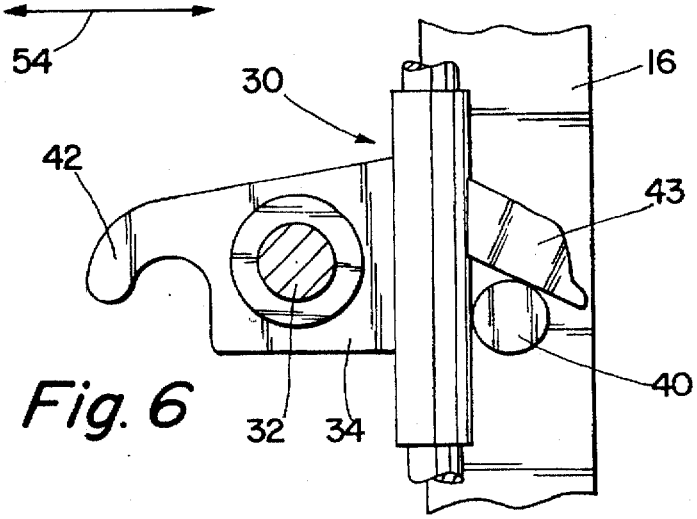
FIG. 6 is a right side view of the safety catch mechanism of the Weightlifting Apparatus of FIG. 1.

Additionally, having the safety pins 41 on the back upright brace supports 16 also allows the lifter 44 to latch the safety catch mechanism 34 to the rear of the apparatus 10. This provides additional safety to the user as some users prefer, or are forced, to latch the bar to the rear of such weightlifting devices. FIG. 5 illustrates this flexible latching ability of the apparatus 10. The bar 32 is initially in the rest position (position A), or latched, on the front upright brace supports 14. The lifter 44 unlatches the safety catch mechanism 34 and lifts the bar 32 by fully extending his arms (position B). When the lifter 44 is completed with his exercise, he or she may return the bar to position A, or may place the bar in a rest position on the back upright support 16 (position C) by latching the rear hook portion 43 of the safety catch mechanism 34 to an appropriate safety pin 40 position on the back upright support 16. FIG. 6 best illustrates the safety catch mechanism 34 in the rest position on the back upright supports 16. FIG. 6 is a right side view of the safety catch mechanism 34 of the invention as depicted in FIG. 1.

FIG. 5 also effectively illustrates the vertical and horizontal mobility of the present invention 10, and the position of the weight bar 32 and the lower and upper movable guide sleeves 26, 28, as the lifter 44 performs an exercise. In position A, the weight bar 32 is in a rest position on the pins 40 and the lower and upper guide sleeves 26, 28 are at the front of the apparatus 10. As the lifter 44 moves the weight bar 32 to position B, the guide sleeve assemblies 30, and the weight bar 32, move up the vertical guide track support members 22 while the lower and upper guide sleeves 26, 28 move horizontally toward the rear of the apparatus 10. While the weight bar 32 is moved to a resting position on the back upright supports 16 (figure C), the lower and upper guide sleeves 26, 28 move further horizontally toward the rear of the apparatus 10.

Another advantage created by the horizontal mobility of the weight bar frame 20 is an improved safety catch system. As mentioned, similar known devices incorporated weight bar frames that were welded to the base of the support frame. This restricted mobility of the weight bar to only the vertical direction. Thus, to disengage the catch mechanism, particularly the hook portion, from the pin it is was resting on, the lifter had to twist the weight bar in an upward and back direction until the hook portion was clear of the pins. Once the catch mechanism was clear of the pins, the lifter could then move the bar in a vertical direction. These twisting motion causes severe stress on the wrist muscles and joints. Additionally, if the bar was not twisted back far enough so that the hook portion of the catch mechanism did not clear the pins, a subsequent vertical motion would be impeded as the hook portion would come into contact with the closest pin.

The ability of the present invention of allowing horizontal mobility solves these problems of the known art. The present invention allows the weightlifter to push the bar up off the pins 40 and then horizontally away from the support frame and pins 40 without having to twist the bar 32. This advantage avoids significant potential for dropping the bar as well as strain to the wrist muscles and joints and may prevent injury such as carpal tunnel syndrome.

Figure 4:
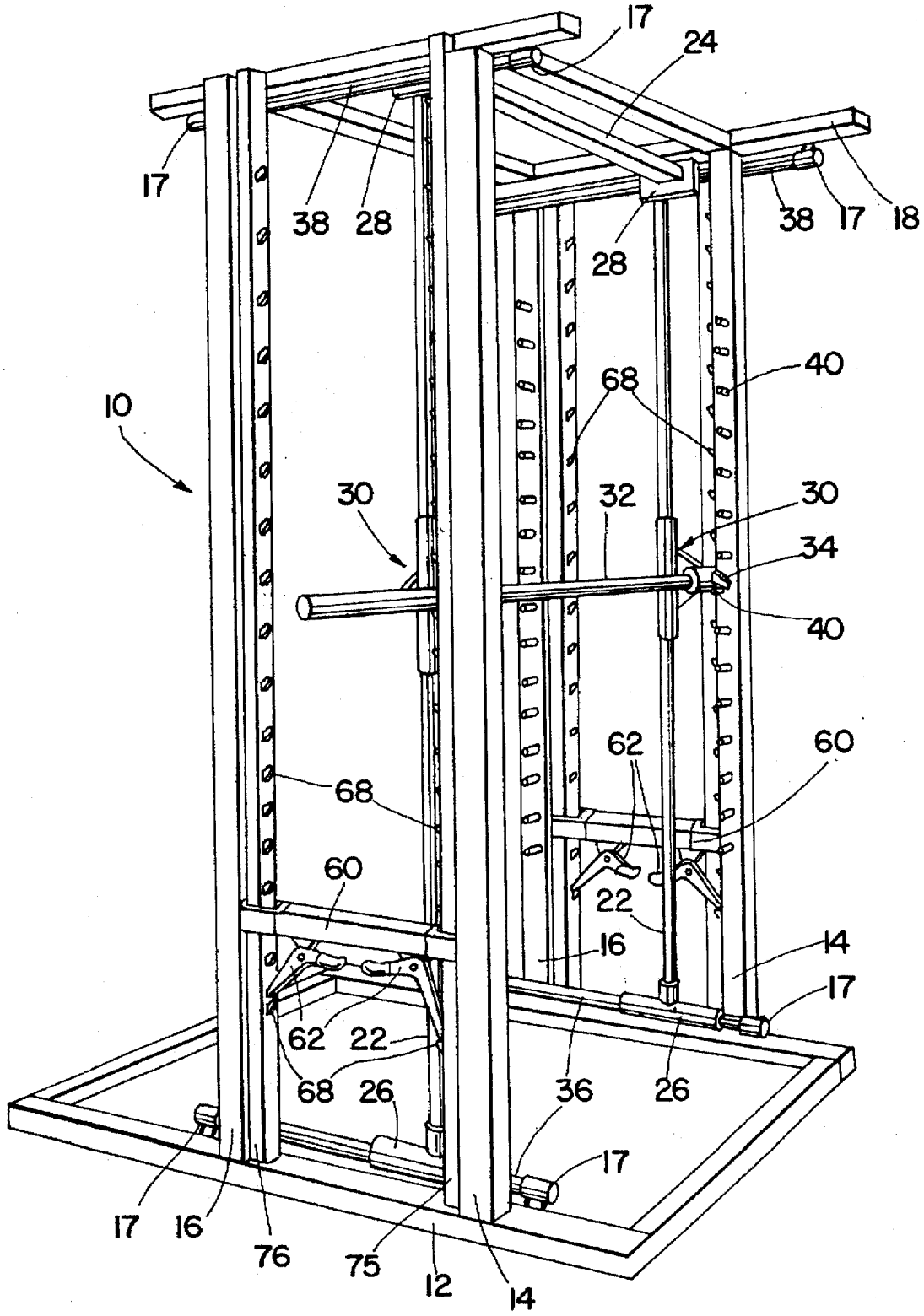
FIG. 4 is a perspective front view of the Weightlifting Apparatus of FIG. 1 with the safety bar.

Additionally, in the preferred embodiment, the present invention has a third safety feature (in addition to the primary and tail hook safety catches 42, 43.) This additional safety feature is a pair of adjustable side safety bars 60, which are positioned perpendicular to the upright brace supports 14, 16 and parallel to the horizontal guide track members 36, 38. (FIG. 4 best illustrates the pair of side safety bars 60, one each running horizontally on the left and right sides of the invention.) These side safety bars 60 may be adjusted, meaning that they can be raised and lowered along the length of the front and back safety bar uprights 75, 76 which run parallel to the upright supports 14, 16.

If a lifter is unable to finish an exercise and is unable to place the weight bar 32 or latch the safety catch 34 back onto the pins 40, the side safety bar 60 provides a rest for the weight bar 32. This prevents potential for serious injury as the weighted bar does not force and trap the lifter to the floor if the lift is missed. For example, as discussed squatting is an exercise in which a lifter places the weight bar 32 across his or her shoulders and then "squats", performing a deep knee bend, until his legs form a right angle, and then rises until the legs are extended. Often times, a lifter performing the squat is unable to rise from the squatting position due to fatigue or muscle weakness. If possible, such a lifter could terminate the exercise by latching the safety catch 34 onto the safety pins 40, 41 on either the front or back upright supports 14, 16, as discussed. However, sometimes the lifter is too weak to even accomplish this latching and falls to the ground. In this situation, the side safety bar 60 would catch the weight bar 32 as it descends. If the side safety bar 60 was not there, the weight bar 32, often loaded with heavy weights, could easily pin the lifter to the floor, seriously hurting him or her. Again, the side safety bar 60 can be adjusted vertically according to the particular user and exercise being performed. Once adjusted to a predetermined position, set by the weightlifter prior to a particular exercise, the side safety bars 60 act to prevent the weight bearing bar 32 from descending past this set position.

Figure 7:
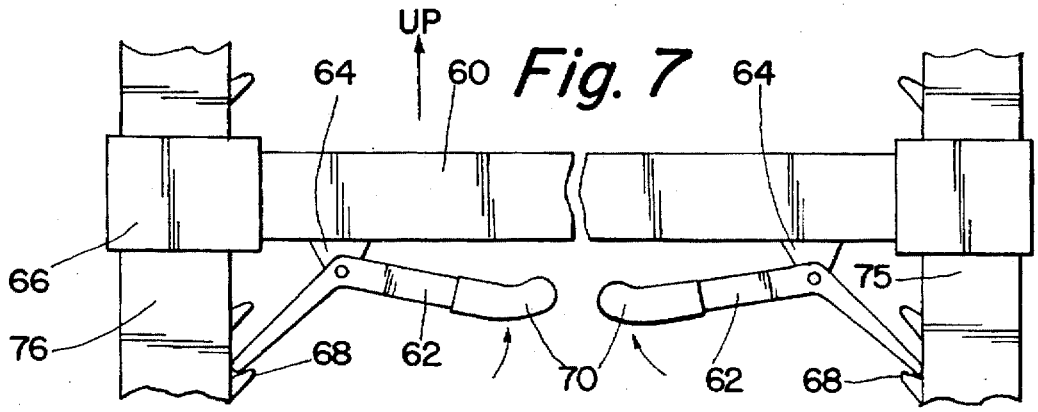
FIG. 7 is a sectional side view of the safety bar of the Weightlifting Apparatus of FIG. 4.

FIG. 7 illustrates an adjustability feature of the side safety bar 60. The side safety bars 60 provide an extra safety precaution in addition to the safety latch mechanism 34. The side safety bars 60 are supported by the a pair of safety bar supports 62 which rest on steel notches 68 located on facing sides of the front and back safety bar uprights 75, 76. The safety bar supports 62 are in a "V" shape and are further comprised of a weighted handle portion 70. The safety bar supports 62 are pivotally connected to a pair of mounts 64 which are connected to the bottom of the side safety bars 60. A lifter can adjust one side safety bar 60 at a time by lifting up simultaneously on both handle portions 70 of the pair of safety bar supports 62. This frees or unlocks the safety bar supports 62 from the steel notches and the lifter can then move the side safety bar 60 up or down to the desired position. The side safety bar 60 moves along the front and back safety bar uprights 75, 76 by a pair of guide sleeves 66 located at the ends of the side safety bar 60. Once at the desired position the lifter lets go of the handles 70 and the weight of the handles 70 locks the safety bar supports 62 onto the respective steel notches 68. After adjusting one side safety bar 60, the lifter can adjust the other side safety bar 60 to the corresponding position in the same fashion.

Having shown and described a preferred embodiment of the invention, those skilled in the art will realize that many variations and modifications may be made to affect the described invention and still be within the scope of the claimed invention. Thus, many of the elements indicated above may be altered or replaced by different elements which will provide the same result and fall within the spirit of the claimed invention.

What is claimed is:

1. A weightlifting apparatus that simulates free weight barbell exercise motions while preventing injury to the weightlifter comprising:

a first front upright brace support member, with a first and a second end;

a second front upright brace support member, with a first and a second end;

a first back upright brace support member, with a first and a second end;

a second back upright brace support member, with a first and a second end;

a pair of vertical guide track support members with a first and a second end;

a pair of lower and upper horizontal guide track members, wherein said first and second front and back upright brace support members serve as stationary support for said pair of lower and upper horizontal guide track members;

a pair of lower movable guide sleeves, attached to said first ends of said pair of vertical guide track support members and wherein said lower movable guide sleeves move horizontally along said pair of lower horizontal guide track members;

a pair of upper movable guide sleeves, attached to said second ends of said pair of vertical guide track support members and wherein said upper movable guide sleeves move horizontally along said pair of upper horizontal guide track members;

a pair of guide sleeve assemblies, movably attached to said pair of vertical guide track support members and wherein said guide sleeve assemblies move parallel to each other along said pair of vertical guide track support members;

a pair of safety catch mechanisms which form a part of said pair of guide sleeve assemblies;

a weight bearing bar supported by said pair of guide sleeve assemblies; and pins attached to said first and second front upright brace support members for placing said pair of safety catch mechanisms.

2. The weightlifting apparatus of claim 1, further comprising:

a base attached to said first ends of said first and second front and back upright brace support members;

an upper base attached to said second ends of said first and second front and back upright brace support members; and an upper support member, which connects said upper movable guide sleeves.

3. The weightlifting apparatus of claim 1 further comprising pins attached to said first and second back upright brace supports.

4. The weightlifting apparatus of claim 3, wherein said pins attached to said first and second front upright brace supports are staggered with the pins attached to said first and second back upright brace supports.

5. The weightlifting apparatus of claim 4, wherein said pair of safety catch mechanisms are each comprised of a primary hooking mechanism which latches onto said pins of said first and second front upright brace support members.

6. The weightlifting apparatus of claim 5, wherein said pair of safety catch mechanisms are each further comprised of a tail hook mechanism for the purposes of latching onto said pins of said first and second back upright brace support members.

7. The weightlifting apparatus of claim 6 wherein said pair of safety catch mechanisms latch onto said pins upon placement onto said pins.

8. The weightlifting apparatus of claim 1, wherein said weight bearing bar moves in both the vertical and horizontal directions.

9. The weightlifting apparatus of claim 1, wherein said weight bearing bar can accommodate weight plates at each end thereof.

10. The weightlifting apparatus of claim 1, further comprising an adjustable safety bar means for preventing said weight bearing bar from descending past a set predetermined position.

11. The weightlifting apparatus of claim 10, wherein said adjustable safety bar means is comprised of:

a first front safety bar upright member, with a first and second end;

a second front safety bar upright member, with a first and second end;

a first back safety bar upright member, with a first and second end;

a second back safety bar upright member, with a first and second end;

a first safety bar, with a first and second end and which is attached to said first front and back safety bar upright members;

a second safety bar, with a first and second end and which is attached to said second front and back safety bar upright members;

wherein said first safety bar is adjustable along the length of said first front and back safety bar upright members;

wherein said second safety bar is adjustable along the length of said second front and back safety bar upright members; and wherein said first and second safety bars prevent said weight bearing bar from descending past said adjusted positions.

12. The weightlifting apparatus of claim 11 further comprising:

a means for locking said first and second safety bar into a stationary position and for unlocking said first and second safety bar from said stationary position so that said first and second safety bar can be adjusted to a desired height.

13. The weightlifting apparatus of claim 12, wherein said means for locking and unlocking said first and second safety is comprised of:

a first guide sleeve, movable along the length of said first front safety bar upright member and attached to said first end of said first safety bar;

a second guide sleeve, movable along the length of said first back safety bar upright member and attached to said second end of said first safety bar;

a third guide sleeve, movable along the length of said second front safety bar upright member and attached to said first end of said second safety bar;

a fourth guide sleeve, movable along the length of said second back safety bar upright member and attached to said second end of said second safety bar;

steel notches attached to said facing sides of said first and second front and back safety bar upright members;

a first mount attached to the bottom of said first safety bar;

a second mount attached to the bottom of said first safety bar;

a third mount attached to the bottom of said second safety bar;

a fourth mount attached to the bottom of said second safety bar;

a first safety bar support, pivotally connected to said first mount;

a second safety bar support, pivotally connected to said second mount;

a third safety bar support, pivotally connect to said third mount; and a fourth safety bar support, pivotally connected to said fourth mount.

14. The weightlifting apparatus of claim 13, wherein said first, second, third and fourth safety bar support is further comprised of a weighted handle portion;

wherein said first safety bar can be adjusted in position by pushing up simultaneously on said weighted handle portions of said first and second safety bar supports which frees said first safety bar from said steel notches thereby allowing adjustability of said first safety bar along said first front and back safety bar upright members; and wherein said second safety bar can be adjusted in position by pushing up simultaneously on said weighted handle portions of said third and fourth safety bar supports which frees said second safety bar from said steel notches thereby allowing adjustability of said second safety bar along said second front and back safety bar upright members.

15. The weightlifting apparatus of claim 1, wherein the weight bearing bar is a standard competition free weight barbell.

16. A weightlifting apparatus for performing exercises, comprising:

a weight bearing bar;

a first structural means in association with said weight bearing bar for guiding movement of said weight bearing bar in the vertical direction;

a second structural means in association with said weight bearing bar and said first structural means for guilding movement of said weight bearing bar in the horizontal direction simultaneous with said vertical movement;

a frame in association with said first and second structural means for providing stationary support to said first and second structural means;

a pair of safety catch mechanisms in association with said weight bearing bar; and a plurality of pins arranged on said frame at various distances up from a bottom of said frame for receiving said pair of safety catch mechanisms.

* * * * *

UNITED STATES PATENT AND TRADEMARK OFFICE

CERTIFICATE OF CORRECTION

PATENT NO. : 5,669,859

DATED : September 23, 1997

INVENTOR(S) : Mariah T. Liggett, et al

It is certified that error appears in the above-identified patent and that said Letters Patent is hereby corrected as shown below:

In column 3, line 30, after the word "second", please delete the word "from" and replace it with -- front --.

In column 4, line 67, after the word "a", please delete the word "fight"and replace it with -- right --.

In column 5, line 22, please italicize the word "simultaneously".

In column 6, line 38, after the word "it", please delete the word "is".

In column 6, line 42, after the word "direction.", please delete the word "These" and replace it with -- This --.

In column 7, line 30, after the word "by", please delete the word "the".

In column 10, line 11, after the word "pivotally", please delete the word "connect" and replace it with -- connected --.

UNITED STATES PATENT AND TRADEMARK OFFICE

CERTIFICATE OF CORRECTION

PATENT NO. : 5,669,859

DATED : September 23, 1997

INVENTOR(S) : Mariah T. Liggett, et al

It is certified that error appears in the above-identified patent and that said Letters Patent is hereby corrected as shown below:

In column 10, line 43, after the word "for", please delete the word "guilding" and replace it with -- guiding --.

Signed and Sealed this

Seventeenth Day of February, 1998

*Attest:*

*Attesting Officer*

Bruce Lehman

BRUCE LEHMAN

*Commissioner of Patents and Trademarks*

UNITED STATES PATENT AND TRADEMARK OFFICE

CERTIFICATE OF CORRECTION

PATENT NO. : 5,669,859
DATED : Sept. 23, 1997
INVENTOR(S) : Liggett, et al

It is certified that error appears in the above-identified patent and that said Letters Patent is hereby corrected as shown below:

Title page, add item [73] Assignee:
--Max Rack, Inc., Columbus, Ohio--

Signed and Sealed this
Third Day of November, 1998

*Attest:*

*Attesting Officer*

Bruce Lehman

BRUCE LEHMAN

*Commissioner of Patents and Trademarks*